US005406751A

United States Patent [19]

Hansen et al.

[11] Patent Number: 5,406,751

[45] Date of Patent: Apr. 18, 1995

[54] ELECTRICAL OPERATOR FOR DOORS AND WINDOWS

[75] Inventors: Jens F. Hansen, Valby; Brent Moller, Gentofte, both of Denmark

[73] Assignee: V. Kann Rasmussen Industri A/S, Soborg, Denmark

[21] Appl. No.: 162,180

[22] Filed: Dec. 15, 1993

[30] Foreign Application Priority Data

Jul. 4, 1991 [DK] Denmark ..... 1302/91

[51] Int. Cl.[6] ..... E05F 11/00

[52] U.S. Cl. ..... 49/325; 49/280

[58] Field of Search ..... 49/25, 192, 324, 325, 49/140, 280, 139

[56] References Cited

U.S. PATENT DOCUMENTS

| | | | |
|---|---|---|---|
| 1,584,198 | 5/1926 | Stevens | 49/324 |
| 4,014,136 | 3/1977 | Hemens et al. | 49/325 |
| 4,481,735 | 11/1984 | Jentoft et al. | 49/325 |
| 4,521,993 | 6/1985 | Tacheny et al. | 49/325 |
| 4,605,252 | 8/1986 | Yamamoto | 49/325 X |
| 5,226,256 | 7/1993 | Fries et al. . | |
| 5,271,182 | 12/1993 | Greisner et al. | 49/325 |

FOREIGN PATENT DOCUMENTS

| | | | |
|---|---|---|---|
| 2486140 | 1/1982 | France | 49/25 |
| 3247733 | 7/1984 | Germany | 49/25 |

*Primary Examiner*—Jerry Redman
*Attorney, Agent, or Firm*—Lane, Aitken & McCann

[57] ABSTRACT

An electrical actuator device for opening and closing doors and windows having an openable frame between a closed position and a ventilation or tilted position comprises an electric drive unit with a reversible motor and associated transmission. The drive unit is accommodated within a housing on a frame member serving to receive a locking mechanism, and the transmission functionally engages a locking mechanism mounted in the frame member and a transfer element, respectively, which by means of a coupling fixture is connected with the main frame, the transmission having a first engagement member and a second engagement member for engaging a first carrier member and a second carrier member, respectively. The first carrier member is functionally coupled with the square shaft and engageable by the transmission for reversible pivoting rotation of the square shaft between positions corresponding to a locking position and a released position of the locking mechanism, and the second carrier member is connected with the transfer element and engageable by the transmission for moving said transfer element in an opening direction in continuation of rotation of said operator shaft to release the locking mechanism and in a closing direction prior to rotation of the square shaft to provide locking engagement of the locking mechanism.

18 Claims, 5 Drawing Sheets

ELECTRICAL OPERATOR FOR DOORS AND WINDOWS

BACKGROUND OF THE INVENTION

The invention relates to an electrical actuator device for opening and closing doors and windows having an openable frame between the closed position in which the door or the window frame are secured in relation to a main frame by locking means and a corresponding locking mechanism mounted in one of the frame members for engagement with recesses or strike plates in the opposite main frame member, and a ventilation position, said device comprising an electrical drive unit with a reversible motor and associated transmission means, the drive unit being accommodated within a housing on said frame member, while a transfer element functionally engaging one of said transmission means is connected with said main frame member by means of a coupling fixture.

From EP-A2-0 397 179 an pasquil-operated bottom-hung tilting-type window is known, in which the locking and releasing of the pasquil members as well as opening and closing of the inwardly openable window frame between the closed position and the tilting or ventilation position may be effected electrically, a motor being mounted in the operating handle of the window for actuating the pasquil members which motor via a conventional square shaft actuates the pasquil transfer mechanism in the actual frame member. For electrically opening and closing the window with released pasquil members there is provided an electrical drive unit mounted on the upper horizontal main frame member for actuating a transfer element retained in a coupling fixture on the window frame. The arrangement is controlled by a microproccesor and further includes one or more sensors for detecting the state of the pasquil members in order to ensure that the opening/closing function is not effected with the pasquil members in the locking position. The signal connections to said sensors as well as the current supply to the two separate motors necessitate complicated electric connection lines to be installed in the window frame proper together with a separate cable loop from the frame to the electric installation built in the main frame.

SUMMARY OF THE INVENTION

It is the object of the invention to provide an actuator device in which one and the same electric drive unit with motor and transmission means is used both for locking and releasing the locking means and for carrying out the opening/closing movements between the closed position and the ventilation or tilting position.

This is obtained according to the invention in that said transmission means is further designed for functional engagement with the locking mechanism mounted in the frame member, the transmission means being designed to engage a first carrier member functionally coupled to a square shaft connected with the locking mechanism for reversible rotation of the square shaft between positions corresponding to a locking position and a released position of said locking means, as well as with a second carrier member connected with said transfer element for moving it in an opening direction or in a closing direction, in continuation of rotating the square shaft to release the locking means and prior to rotating the square shaft for closing the locking means, resp.

The electric drive unit according to the invention is mounted on the frame member in which the locking mechanism is received instead of the general operating pivot handle with a square shaft.

With the view of utilizing the same implementation of the drive member with associated housing for mounting on an arbitrary one of the vertical frame members an advantageous embodiment of the actuator device according to the invention is characterized in that the housing is shaped as an oblong box with an opening for the transfer element in one of the lateral walls and being provided in each of the opposite lateral walls perpendicular to said wall with key grooves for engagement with a mounting rail secured to said frame member and a cover rail, respectively.

The transfer element between the electrical drive unit and the coupling fixture mounted on the main frame of the door or window may appropriately according to the invention be a hollow bowden-element or another stable stay member, one end of which is designed to be secured in said coupling fixture, electric connection lines for current supply to the motor being carried through the bowden-element to contact members at said one end in electric connection with contact members in the coupling fixture. Ugly-looking separate cable or line connections between the main frame and the frame are thereby avoided.

According to a further advantageous embodiment the square shaft for operating the locking mechanism is carried outside the housing and connected with an operating pivot handle which is normally released from the square shaft but may be forced into engagement therewith by means of a spring-biassed activation element. By means of said operating handle the locking mechanism may whensoever be manually operated, e.g. in case of power failure or if it is desired to open the door or window beyond the ventilation or tilting position by rotation about a generally vertical axis, for instance with respect to window cleaning.

In this respect it may be ensured through a particular design of said second carrier member that the electrical manoeuvering is automatically clutched in as soon as the electrical operation takes place again after power failure or a possible manual operation.

The compact design of the electric drive unit entails that the actuator device according to the invention may be mounted on most common windows and doors with pasquil closure or other types of locking means and the device is, moreover, extremely appropriate for remote control and remote indication, e.g. because sensors for detecting the state of the locking means, a signal receiver for wireless, e.g. infrared remote control signal transfer and/or an alarm may be mounted directly within the housing without the need for long electric connection lines.

BRIEF DESCRIPTION OF THE DRAWINGS

The invention will now be explained in detail in connection with an embodiment of the invention as a pasquil-operated pivotal/tiltable window, with reference to the drawings, in which FIG. 1 in an exploded isometric view illustrates the housing in an embodiment of an actuator device according to the invention.

DESCRIPTION OF THE PREFERRED EMBODIMENTS

Figure 1:
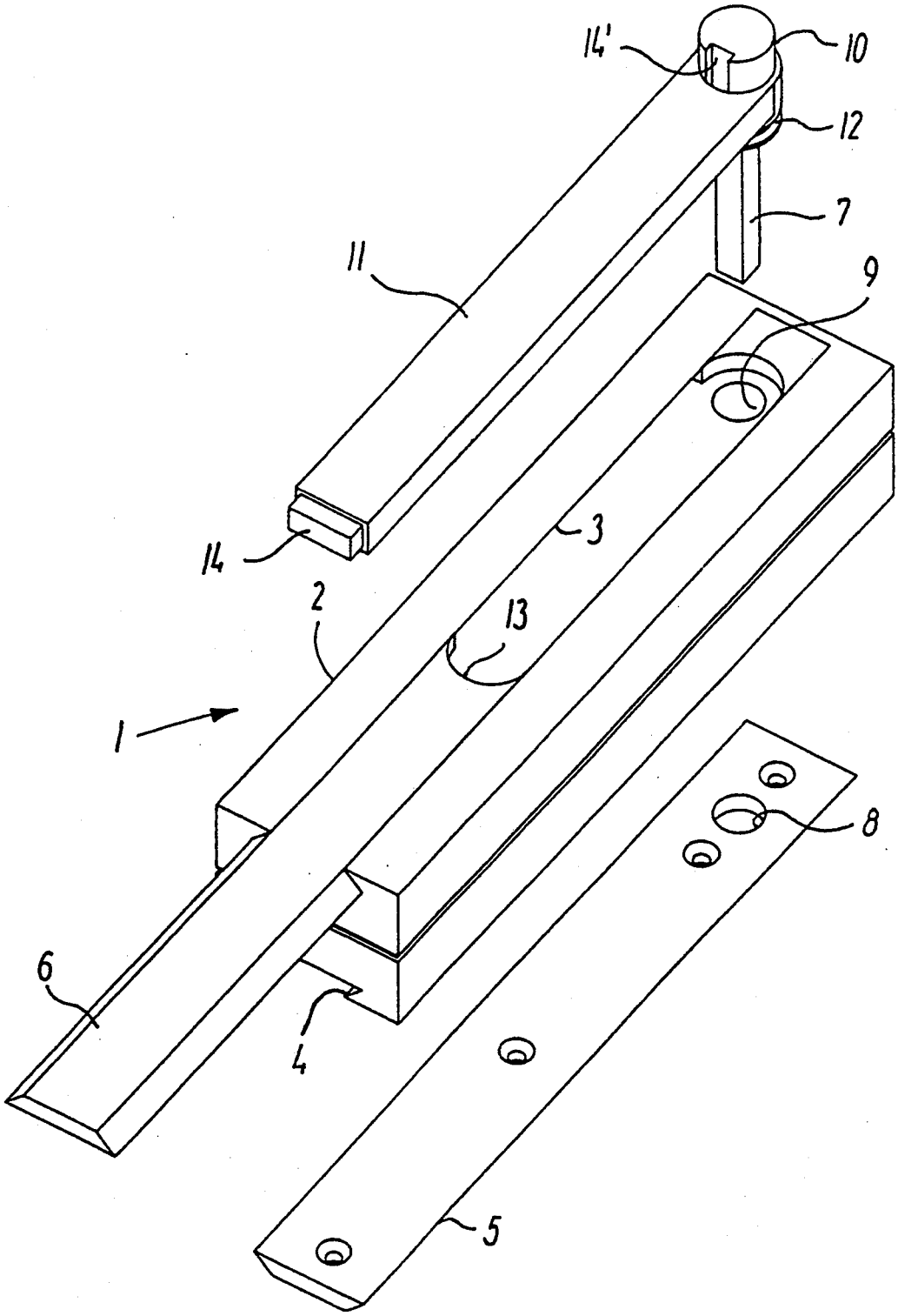

The housing illustrated in FIG. 1 and accommodating the electric drive unit with motor and transmission means is designed with an oblong box-shape in order to be mounted directly on the vertical frame member in a door or a window (not shown), in which the locking mechanism is received.

With a view to facilitate the mounting and allowing securing on any of the vertical frame members the housing 1, from which the transfer element for the opening/-closing movement, which in the embodiment shown is designed as a hollow bowden-element, is passed through a side wall 2, has in each of the top and bottom walls perpendicular to the side wall 2 a key groove 3 and 4, respectively, for engagement with a mounting rail 5 screwed on the actual vertical frame member and a cover rail 6, respectively. In connection with the mounting on one vertical frame member use is thus made of the one key groove 4 for engagement with the mounting rail 5 while the other key groove 3 is used for that purpose in connection with mounting on the other vertical frame member. The two key grooves 3 and 4 may as shown have a dovetailed cross-section corresponding to the trapezoidal cross-section of the mounting and cover rails 5 and 6.

For actuating the locking mechanism which may typically be a pasquil transfer mechanism the housing 1 accommodates a square shaft 7 that is inserted in the frame member through a hole 8 made for that purpose in the mounting rail 5 and on the opposite side is passed out through a hole 9 in key groove 3. Outside the housing the square shaft ends in a coupling part 10 for engagement with an operating handle 11 to be used for manual operation. An annular slot 12 for engagement with a cutout 13 at one end of the cover rail 6 is provided at the transition between the square shaft 7 and the coupling part 10, the square shaft 7 being thereby secured in the axial direction.

The engagement between the coupling part 10 and the operating handle 11 is designed so that the operating handle is normally released from the square shaft but may be forced into functional engagement with the shaft by actuating a spring-biassed activation element 14. In order to facilitate this activation the end of the square shaft 7 positioned outside the housing may be provided with a visual marking of the position of the locking mechanism, e.g. as shown in the form of a key groove 14' with which the activation element 14 may engage.

In order to obtain protection against burglary and provide child proofing the operating handle may include a blocking device to prevent the handle from engaging the square shaft.

Figure 2:
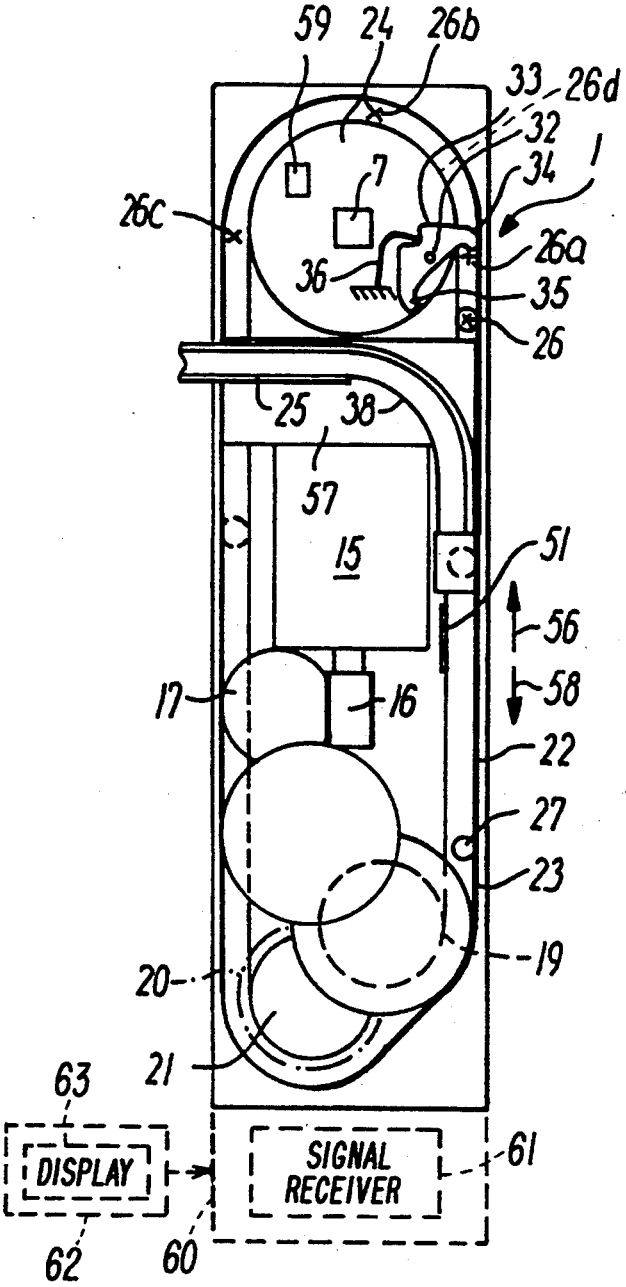
FIGS. 2 and 3 illustrate the motor- and transmission arrangement in a first embodiment of the electric drive unit, viewed from the front and in a side elevation, respectively.
Figure 3:
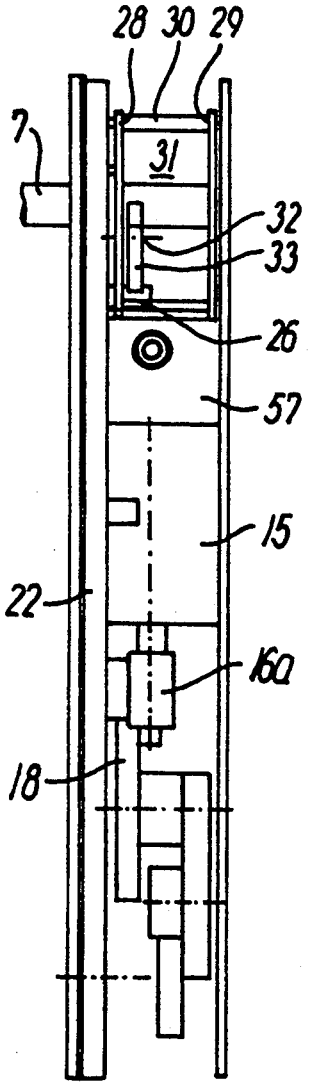

As it appears from FIGS. 2 and 3, the electric drive unit includes a reversible electric motor 15 whose output shaft over a gear transmission with gears 16 to 20 drives a sprocket wheel 21 for an endless chain 22 the path of which is determined by means of rotatable guide discs 23 and 24 at either end of the housing. Instead of an endless chain 22 a toothed belt or the like, preferably a frictionless transmission means, may be used as transmission means.

Engagement members in the form of two pins 26 and 27 are fixed to the chain 22 for actuating the square shaft 7 engaging with the locking mechanism and the bowden-element 25 serving as transfer element for the opening/closing movements.

In the illustrated embodiment the square shaft 7 is by means of square holes, not shown, secured in two discs 28 and 29 which by means of connecting stiffeners 30 form a wheel 31 having the same axis as the chain guide disc 24.

A first carrier member 33 in the form of a bistable element with two arms 34 and 35 is journalled between the discs 28 and 29 on a pin 32 excentrically secured in disc 28. As schematically shown in FIG. 2, the bistable element 33 is influenced by a spring-bias 36.

The electric manoeuvering of the square shaft is effected by engagement between the pin 26 secured to the chain 22 and one or the other of the two arms 34 and 35 of the bistable element 33, as explained in detail in the following.

Figure 4:
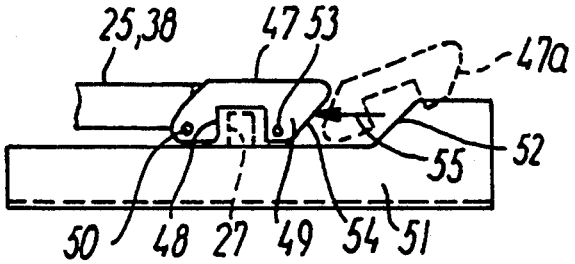
FIGS. 4 and 5 are details of the connections between a transfer element for the opening/closing movements and the transmission arrangement, respectively, of the electric drive unit and the coupling fixture secured on a main frame member.
Figure 5:
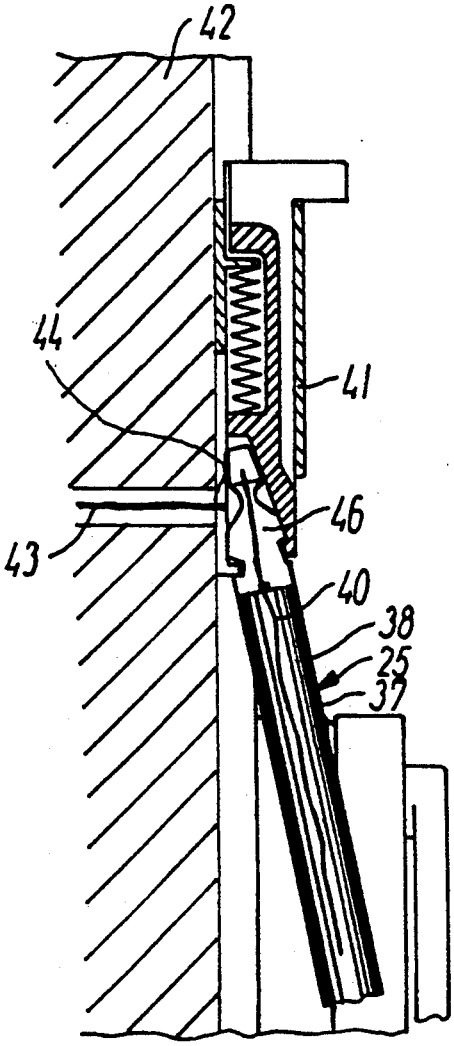

In the embodiment shown in FIGS. 2 to 5 the transfer element for the opening/closing movements is constituted by a bowden-element 25 which as shown in FIG. 5 comprises an external mantle 37 encompassing a hollow cable 38 through which connection lines 40 are drawn for power supply to the motor 15.

The bowden-element 25 is by means of a coupling fixture 41 secured to the main frame member 42 opposed to the vertical frame member on which the housing 1 is mounted. The electric contact between the connection lines 40 and a cable installation 43 in the main frame member 42 is established by means of two or more contact points 44 in the coupling fixture 41 and corresponding contact points 45 at the end of a hinge link 46 on the bowden-element that is removable from the coupling fixture 41 in order to allow the door or window to open beyond the ventilation or tilting position.

In housing 1 the cable 38 of the bowden-element 25 is connected with a second carrier member 47 which as shown in FIG. 4 is designed as a mainly U-shaped element with downwards facing opening for engagement with the pin 27 secured to the chain 22. The carrier member 47 thus includes a first striking member 48 for engagement with the pin 27 by movement in the opening direction and a second striking member 49 for engagement with the pin 27 by movement in the closing direction. The carrier member 47 is pivotally connected with the hollow cable 38 of the bowden-element by means of a pin 50 and cooperates with a guide 51 stationarily fastened in the housing and having an inclined guideway section 52 by means of which the part of the carrier member accommodating the striking member 49 may be lifted to release the carrier member 47 from the pin 27.

In view of the fact that the carrier member 47 in its home position with closed door or window thus occupies the position 47*a* shown in dotted lines in FIG. 4, it is possible from this position to open the door or the window manually to the ventilation or tilting position without releasing the bowden-element 25 from the coupling fixture 41. The guideway section 52 on the guide 51 effects the lifting of said portion of the carrier member 47 by means of a transverse stiffener 53.

The part of the carrier member 47 accommodating the second striking member 49 is, likewise as shown, designed with an inclined surface 54 which makes it possible to perform the same lifting movement by means of the pin 27 when this pin from a position outside the carrier member 47 is moved in the direction shown by the arrow 55.

This entails that if the window has been opened by manual operation as described above, the electrical actuation will automatically be reestablished by activation of the motor 15.

Manual operation of the door or the window is possible in all phases by release of the bowden-element 25 from the coupling fixture 41 and use of the pivot handle 11. The operation is thus effected in the same manner as for a door or a window without an electrical actuator device.

The actuator device according to the invention operates in the following manner. When the motor 15 is activated in the closed position of the door or the window and with the locking means in locking engagement, the pin 26 occupies the position shown in FIG. 2 and the chain 22 is driven in the direction shown by the arrow 56. After a short free movement, pin 26 in the position 26*a* engages the arm 34 on the bistable member 33, thereby moving said carrier member along with the chain and the wheel 31 is pivoted correspondingly to rotate the square shaft 7. In the position 26*b* normally attained after a 180°-rotation, the pasquil members have been drawn clear of the engagement with the strike plate in the main frame so that they cannot be moved any further. The power supply to the motor 15 will then rise so much that the spring loading on the bistable element 33 is overcome, thereby pivoting the bistable element to its other stable position, whereby the pin 26 is released from the engagement with the arm 34.

When the position 26*b* has been passed, pin 27 engages the carrier member 47 which in its initial position as mentioned occupies the position 47*a* shown in dotted lines in FIG. 4. The pin 27 is thereby brought into engagement with the striking member 48 and drives the bowden-element 25 in the opening direction corresponding to the arrow 56. In order to confine the travelling of the bowden-element 25 the housing includes an adjustable stop 57 against which the carrier member abuts when the frame attains the ventilation or tilting position thus determined by the stop 57. The power supply to the motor then rises which is detected in a motor control circuit, not shown, which thereby switches off the motor.

During this opening movement the pin 26 has arrived at the position 26*c* shown in FIG. 2.

Upon closing the window the motor 15 is activated to rotate in the opposite direction and the pin 27 will now by means of the carrier member 47 carry the bowden-element 25 along in the direction of the arrow 58 until the carrier member 47 has attained the position 47*a* shown in dotted lines in FIG. 4. During the continued movement of the chain 22 the pin 27 is now released from the engagement with the carrier member. At the same time the pin 26 has moved from its starting position 26*c* to the position 26*b* in which it comes into engagement with the second arm 35 on the bistable element 33, thereby causing the wheel 31 and thus the square shaft 7 to rotate in the closing direction until the initial position 26*a* has been attained. In this position the square shaft 7 is blocked and the motor power increases to overcome the spring bias 36 on the bistable element 33 which now again tilts to the position shown in FIG. 2, whereby the pin is released and made to abut on the stop 57. The motor power thus increases and the motor is stopped as described above.

In the above description of function it is supposed that the frame has been brought into its tilting state in the position of the square shaft 7 that is occupied when the locking members have been released, i.e. at a rotation of 180°. With the view of adjusting the actuator device to frames requiring a 90°-rotation of the square shaft to come into the tilting state, the tilting of the bistable element must take place already in position 26*d* which may be effected by means of a stop pin actuating the bistable element 34.

The compact design of the electric drive unit for the actuator device according to the invention allows in a simple manner the addition of sensors for recording the state of the locking means, because such sensors 59 may be mounted within the housing 1 and cooperate with the wheel 31.

The operation of the drive unit may be effected by means of control switches mounted on the window main frame or in the vicinity thereof, but the compact design makes the assembly appropriate for remote operation by supplementing the housing 1, as schematically shown in FIG. 2, with an additional module 60 containing a signal receiver 61 for wireless transmitted operating signals for activating the motor.

A corresponding remote operating signal transmitter may be provided with a display for showing the state of the window or the door, i.e. the position of the locking members and the degree of opening in the ventilation and tilting position.

In designs in which the operation takes place directly on the spot of installation, such a display 63 may instead be accommodated in an additional module 62. Such electric additional equipments may like the motor be supplied with current through lines passed through the hollow bowden-element 25.

Figure 6:
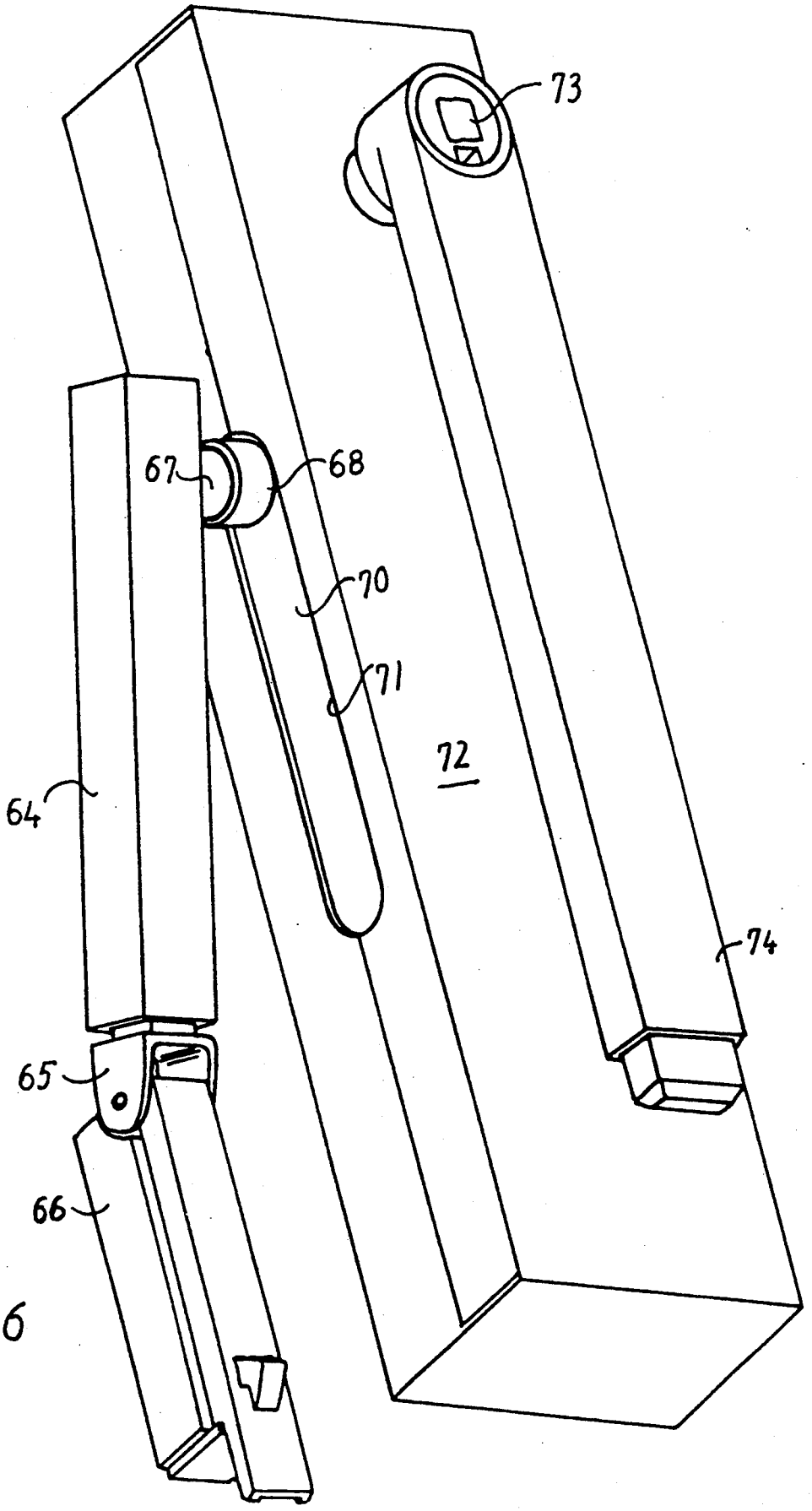
FIG. 6 illustrates the housing with pivot handle in connection with a stay arm and a main frame fixture of a second embodiment of the actuator device according to the invention.
Figure 7:
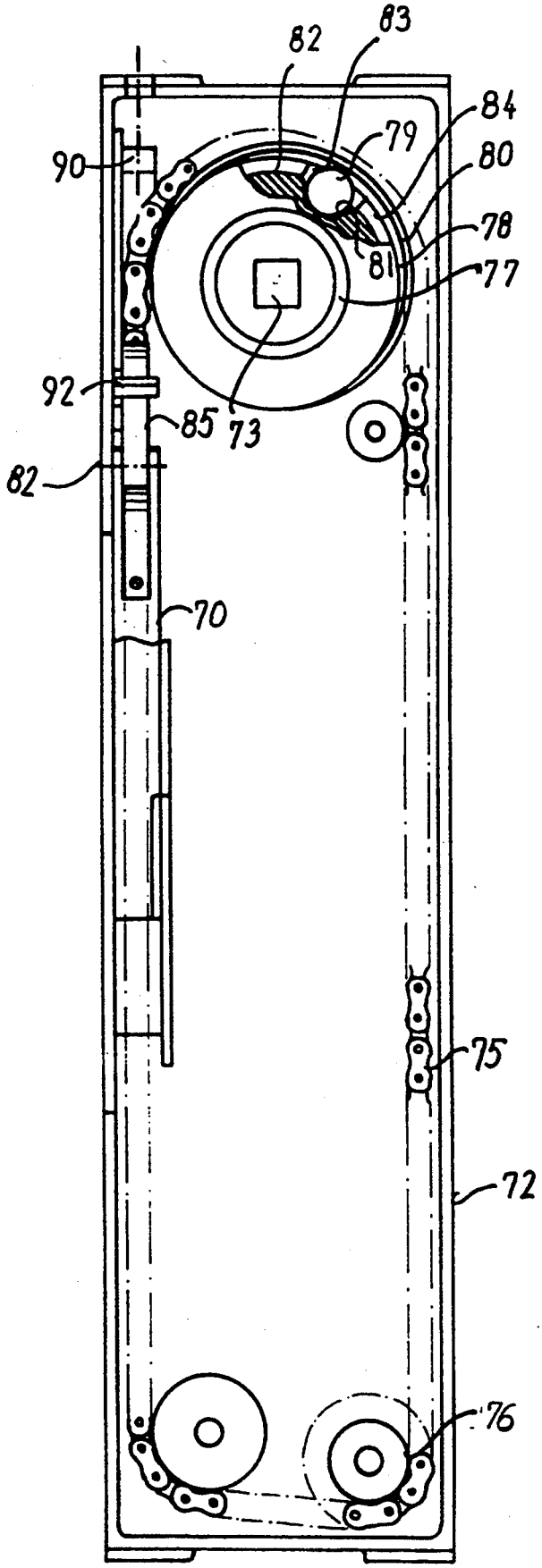
FIGS. 7 and 8 illustrate the motor and transmission arrangement of a second embodiment of the electric drive unit.
Figure 8:
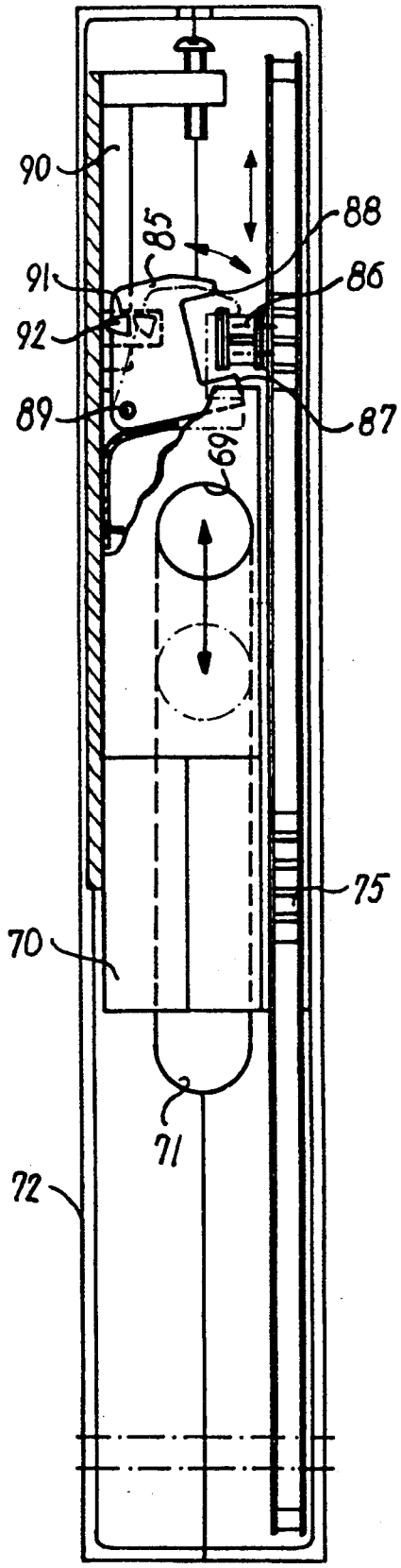

In the embodiment in FIGS. 6 to 8 the transfer element for the opening/closing movement is constituted by a stiff stay arm 64 which at one end by means of a pivot link 65 is connected with a main frame fixture 66 and at the other end carries a protruding pivot pin 67 inserted in a bushing 68 mounted in a bore 69 in a guide rail 70 positioned inside a slot 71 in one lateral wall of the housing 72 of the actuator device.

The square shaft 73 for operating the locking members is connected with an operating pivot handle 74 that may be designed in the same manner as in the embodiment in FIGS. 1 to 5.

Also in the embodiment in FIGS. 6 to 8 the manoeuvering of the locking mechanism as well as of the transfer element shaped as a stay arm is effected by means of an endless chain 75 in that a sprocket wheel 76 engaging therewith over a gear transmission, not shown, which may be designed in the same manner as shown in FIGS. 2 and 3, is connected to the reversible elctric motor, likewise not shown.

The hole for the square shaft 73 is provided in a bushing 77 which by means of a releasable coupling may be connected with a sprocket wheel 78 engaging the chain, said sprocket wheel constituting in this embodiment the first carrier member. The releasable coupling is provided as a roller coupling by engagement between a loose coupling roller 79 which by an external helical spring 80 is kept squeezed into a recess 81 parallel to the axis in the cylindrical external side of a hub bushing 82 through a cutout 83 likewise parallel to the axis and provided in a cylindrical collar member 84 connected with the bushing 77. In the activated position of the coupling the cutout 83 is firmly locked in relation to the recess 81 by means of the coupling roller 79. The release of the coupling is effected in that the rotation of the bushing 77 is blocked when the locking members in each of their extreme positions, the locked position and the released position, respectively, hit a stationary stop or striking member, continued rotation of the sprocket wheel 78, thereby urging the coupling roller 79 out of the recess 81 against the influence from the helical spring 80 so that continued rotation of the sprocket wheel 78 in relation to the retained bushing 77 with the collar member 84 is made possible.

In the embodiment according to FIGS. 6 to 8 the second carrier member is constituted by a latch 85 that is pivotally connected with one end of the slide guide 70 connected with the pivot pin 67 of the stay arm 64. The latch 85 is in the same manner as the carrier member 47 in the embodiment according to FIGS. 1 to 5 designed as a mainly U-shaped element with downwards facing opening for engagement with a carrier member 86 projecting upwards from the chain 75 and which, as shown, may consist of a chain link superposed one of the links of the chain 75. The latch 85 thus includes a first striking member 87 for engagement with the projecting chain link 86 by movement in the opening direction and a second striking member 88 for engagement with the chain link 86 by movement in the closing position. The latch 85 is spring-biassed against the position shown in solid lines in FIG. 8, in which the second striking member is lifted above the movement path of the projecting chain link 86.

The pivot pin 89 for the pivotal connection of the latch 85 with the slide guide 70 is positioned substantially vertically above the first striking member 87. The latch 85 cooperates with a guide 90 stationarily secured in the housing 72 and in which a recess 91 is provided for receiving a cam 92 laterally projecting from the latch 85 in the position of the latch shown in solid lines. When the chain link 86 strikes the member 87 against the spring-bias the projecting cam 92 may from said position be released from the engagement with the recess 91 in the stationary guide 90, thereby entraining the latch 85 and the slide guide 70 under continued movement of the chain 75 in the opening direction.

The pivot pin 67 of the stay arm 64 is thus displaced towards the opposite end of the slot 71 in the lateral wall of the housing 72, thereby opening the window or door to the ventilation of tilting position.

When the actuator device is operated to move in the closing direction, the latch 85 and the slide guide 70 are entrained by the striking of the projecting chain link 86 against the second striking member 88 of the latch 85. When the slide guide has moved so much that the projecting cam 92 of the latch 85 is positioned opposite the recess 91 in the stationary guide 90 the latch 85 is released from the engagement with the protruding chain link 86 by means of the spring-bias. The sprocket wheel 78 will concurrently be pivoted so much backwards that the recess 81 in bushing 82 is again positioned opposite the cutout 83 in the collar member 84, thereby reestablishing the connection between the chain link 78 and the bushing 77 by means of the spring-biassed coupling roller 79, and causing the locking members under continued rotation of the sprocket wheel 78 to occupy the locking position.

By movement in the closing direction the motor power increases due to the actuation exerted by the helical spring 80 on the coupling roller 78 when this roller by the stopping of the locking means in the locking position is urged out of engagement with the recess 81 in the hub bushing 82.

The switching-off of the motor power by movement in the opening or closing directions may be exactly determined by microprocessor-control.

Also in the embodiment according to FIGS. 6 to 8 the electric connection lines for current supply to the reversible electromotor and to additional modules may be passed through the stay arm 64.

The embodiment in FIGS. 6 to 8 may like the embodiment in FIGS. 1 to 5 also be carried out for mounting at either sides of a window, designing the housing to be reversed 180° with the possibility of exchanging the mounting of the locking mechanism and the gear transmission with the sprocket wheel 78.

Even though the invention has been described hereinbefore solely with reference to pasquil-operated tiltable windows the actuator device may be used in any type of windows and doors in which the frame in the locking position is secured to the main frame by means of locking members activated and released by a pivoting movement. The transfer element for the opening/closing movement may be designed in another way than illustrated and described above, so that the actuator device may as well be applied to sliding windows and doors that are opened and closed by means of cord drives or the like.

It is claimed:

1. An electrical actuator device for doors and windows having an openable frame composed of frame members, for opening and closing the openable frame between a closed position and a ventilation position, said device comprising a locking mechanism mounted in one of said frame members, said locking mechanism including locking members for engagement with an engagement structure provided in an opposite main frame member, an operator shaft of non-circular cross-section, and an electrical drive unit including a housing mounted on said frame member, a reversible motor and associated transmission means accommodated within said housing and a transfer element functionally engaged by said transmission means, a coupling fixture being provided for connecting said transfer element with said main frame member, said transmission means being further designed for functional engagement with said locking mechanism, a first carrier member being functionally coupled with said operator shaft and engageable by said transmission means for reversible pivoting rotation of said operator shaft between positions corresponding to a locking position and a released position of said locking members with respect to said engagement structure, a second carrier member being connected with said transfer element and engageable by said transmission means for moving said transfer element in an opening direction in continuation of rotation of said operator shaft to release said locking members and in a closing direction prior to rotation of said operator shaft to provide locking engagement of said locking members with said engagement structure.

2. An electrical actuator device according to claim 1, characterized in that said transmission means (22; 75) includes an endless chain driven by the motor (15) and carried over the first carrier member (33; 78), said chain having a movement path, an engagement member (27; 86) being secured to said chain and, upon movement of the chain, being carried for a distance along the movement path corresponding to a distance of movement of the second carrier member (47; 85) between positions of the second carrier member corresponding to the closed position and the ventilation position of the window.

3. An electrical actuator device according to claim 2, characterized in that the first carrier member (33) is a bistable element having a first arm and a second arm, said bistable element being pivotal about a pin (32) connected with an element (31) which is connected with the operator shaft (7) and which is freely rotatable in relation to a guide disc (24) for the chain (22), means for spring-biasing said bistable element into positions in which the first arm and the second arm, respectively, are seized by a second engagement member connected with the chain, wherein the spring-biasing means acts on the bistable element in positions of said pivotal element (31) corresponding to the locking position and the released position of the locking members, respectively, to bias the bistable element (33) into positions in which the first arm and the second arm (34, 35), respectively, are seized by a second engagement member (26) connected with the chain (22), the spring-biasing means having a spring force adjusted with respect to a predetermined maximum value of the power of the motor in such a way that, at increasing motor power due to blocking of the movement of the locking members upon occupying the locking position and the released position, the bistable element is moved by the spring force to its other stable position for releasing the bistable element from the engagement with the second engagement member (26).

4. An electrical actuator device according to claim 2, characterized in that the first carrier member (78) is a sprocket wheel engaging the chain (75) and communicating with an element (77) connected with the operator shaft (73) through a releasable coupling for releasing the operator shaft (73) from connection with the sprocket wheel (78) when the locking members reach a closing position and a released position, respectively.

5. An electrical actuator device according to claim 4, characterized in that the releasable coupling is a roller coupling with a loose coupling roller (79) which by means of a spring (80) is kept in engagement with opposite recesses (81, 83) in cylinder walls (82, 84) connected with the operator shaft (73) and the sprocket wheel (78), respectively, the loose coupling roller being urged out of said engagement when the rotation of the operator shaft (73) is blocked in said locking position and said released position, respectively.

6. An electrical actuator device according to claim 2, characterized in that the second carrier member (47; 85) is provided with a first abutment (48; 87) for said engagement member (27, 26) when moving in the opening direction and a second abutment (49; 88) for the engagement member (27; 86) when moving in the closing direction.

7. An electrical actuator device according to claim 6, characterized in that the second abutment has a movement path and that the second abutment (49), in a position corresponding to the closed position of the openable frame, is actuated by a stationary guide (51) for displacement to a position outside the movement path of the second engagement member (27).

8. An electrical actuator device according to claim 6, characterized in that the second abutment (49; 88) is displaceable in order to allow passage of the engagement member (27; 86), when moving in the opening direction from a position in which the engagement member is released from the second carrier member (47; 85).

9. An electrical actuator as claimed in claim 8, characterized in that, for operating the locking mechanism, the operator shaft (7; 73) extends outside the housing (1; 72), the operator shaft being connected with an operating pivot handle (11; 74) which is normally released from the operator shaft (7; 73) but which can be forced into engagement with the operator shaft by means of a spring-biased activation element (14).

10. An electrical actuator device according to claim 9, characterized in that the operating pivot handle (11; 74) includes a stop device which, in order to obtain protection against theft and provide child proofing, may prevent the handle from engaging with the operator shaft.

11. An electrical actuator device according to claim 9, characterized in that the operating pivot handle is provided with an indicator for an angular position of the operator shaft.

12. An electrical actuator device according to claim 1, characterized in that the housing (1) is shaped as an oblong box having a first lateral wall, second and third opposed lateral walls perpendicular to said first lateral wall, and an opening for the transfer element in said first lateral wall (2) said housing being provided in each of said second and third opposed lateral walls perpendicular to said first lateral wall with key grooves for engagement with a mounting rail (5) secured to said frame member and with a cover rail (6), respectively.

13. An electrical actuator device according to claim 12, characterized in that the transfer element is a stable stay member having one end (46) to be secured in said coupling fixture (41; 66), and electric connection lines (40) for current supply to the motor (15) pass through the stay member (25; 64) to contact members (43, 44) at said one end in electric connection with contact members in the coupling fixture.

14. An electrical actuator device according to claim 13, characterized in that an additional module (61) having a display for showing a pasquil position and the degree of opening of the openable frame is connected with the housing.

15. An electrical actuator device according to claim 13, characterized in that said stable stay member is a hollow bowden element.

16. An electrical actuator device according to claim 1, characterized in that the transfer element (25) is removably fixed in the coupling fixture (41).

17. An electrical actuator device according to claim 1, characterized in that sensors (59) for the detection of an angular position of the operator shaft (7) are accommodated in the housing.

18. An electrical actuator device according to claim 1, characterized in that an additional module (60) containing a signal receiver for operating the motor by wireless signal transfer is connected with the housing.

* * * * *